US006119356A

United States Patent [19]

Frankland

[11] Patent Number: 6,119,356

[45] Date of Patent: Sep. 19, 2000

[54] PARALLELOGRAM TOOL FOR LOCATING STAIRWAY AND STAIR LANDING RAILINGS

[76] Inventor: Brad G. Frankland, P.O. Box 1209, McCall, Id. 83638

[21] Appl. No.: 09/104,161

[22] Filed: Jun. 24, 1998

[51] Int. Cl.[7] ..... G01B 21/22; B43L 7/10

[52] U.S. Cl. ..... 33/454; 33/452; 33/526; 33/534

[58] Field of Search ..... 33/454, 25.1, 25.2, 33/25.3, 25.4, 25.5, 418, 456, 526, 562, 645, 664, 41.1, 415, 452, 459, 478, 534, 535

[56] References Cited

U.S. PATENT DOCUMENTS

| | | | |
|---|---|---|---|
| 669,549 | 3/1901 | Roche . | |
| 785,756 | 3/1905 | Nutz | 33/454 |
| 1,559,386 | 10/1925 | Valentine | 33/452 |
| 1,919,551 | 7/1933 | Griffin | 33/478 |
| 3,788,608 | 1/1974 | Raymond et al. . | |
| 4,138,094 | 2/1979 | Thir | 256/67 |
| 4,397,090 | 8/1983 | Nicyper . | |
| 4,527,341 | 7/1985 | Schon . | |
| 4,601,108 | 7/1986 | Swanson | 33/454 |
| 4,813,149 | 3/1989 | Herkimer | 33/462 |
| 5,461,798 | 10/1995 | Ribeiro . | |
| 5,527,016 | 6/1996 | Wilkerson, Jr. . | |
| 5,713,135 | 2/1998 | Acopulos | 33/451 |
| 5,732,474 | 3/1998 | Cannon | 33/452 |

*Primary Examiner*—Andrew H. Hirshfeld
*Assistant Examiner*—R. Alexander Smith
*Attorney, Agent, or Firm*—Ken J. Pedersen; Barbara S. Pedersen

[57] ABSTRACT

Embodiments of a stairway or walkway handrail construction tool are shown and described, each embodiment comprising a frame of four outer members. The members are pivotally joined at or near each end and can thus be moved to form a square or rectangle and variously-angled parallelograms. Whether used on sloping stairs or flat floors, the top and bottom members of the tool will be parallel to each other and to the corresponding stair slope or floor. Thus, the invention may be placed temporarily in the subject location, it may be adjusted up or down according to taste or other criteria to chose a particular configuration for the prospective rail, and then the inventive device may be used to mark, align, plan, and/or visualize the layout of the railing or other feature for its construction. The preferred tool may be fully collapsed to a nearly-flat configuration, to make it very portable and amenable to transport within a case such as a carpenter's level case.

16 Claims, 11 Drawing Sheets

PARALLELOGRAM TOOL FOR LOCATING STAIRWAY AND STAIR LANDING RAILINGS

BACKGROUND OF THE INVENTION

1. Field of the Invention

The invention relates to the field of tools and/or jigs as aids in locating or aligning a handrail or other stair or landing railing to its desired position, or in visualizing how such a railing might function or appear before it is installed.

2. Related Art

Handrails for stairs are normally required by relevant building codes or, at least, are very desirable. Building codes, ergonomics, and good practice require that such rails be installed parallel to the slope of the stairs and at a certain, convenient height above the stair treads. Good and expedient installation of stair rails, however, is made difficult by the nature of stairs. Stairs typically vary as to the height of the risers, the run of the treads, and, consequently, their slope. Installation is further complicated by the narrow, three-dimensional nature of stairs and stair ways and by traffic there which often must be accommodated during handrail installation. Thus, a need exists for a tool to facilitate efficient installation of stair handrails.

Wilkerson in U.S. Pat. No. 5,527,016 (issued June, 1996) discloses a"Handrail Positioning Device" for positioning a handrail above stairs during the permanent installation process. The device features adjustable-height screw jack stanchions to be screwed to the stair treads near the top and bottom of the stairs; the handrail is then clamped to adjustable arms on the stanchions. Raymond et al. in U.S. Pat. No. 3,788,608 (issued January, 1974) discloses a modular hand rail similar in some regards to Wilkerson but for temporary uses such as bleacher handrails rather than as an aid to permanent installation. The present invention, like Wilkerson, is an aid to installing handrails but functions very differently to help visualize where handrails might best be located and then to delineate the chosen location. Both Wilkerson and Raymond are classified within U.S. Class 256.

Pantographs and other aids for drawing and marking have been made which may include a parallelogram or other four sided structure. Scan in U.S. Pat. No. 4,527,341 (first issued in Sweden, October, 1983) discloses an"Angle Determination of Parallelogram Type". Nicyper in U.S. Pat. No. 4,397,090 discloses a parallelogram pantograph for graphically reproducing images. Riche in U.S. Pat. No. 669,549 discloses a pantograph for marking or cutting boot or shoe patterns.

None of the related art approaches the simplicity of the present invention and none is adapted for quick and efficient use as a handrail construction tool. Therefore, there remains a need for a handrail tool which is simple and convenient to carry and use and which assists designers, builders, and consumers alike in selecting and then implementing a handrail design.

SUMMARY OF THE INVENTION

The present invention is, in its most basic sense, a handrail construction tool comprising a parallelogram of four sides, not necessarily of equal length except that the directly-opposing sides are of equal length. The straight longitudinal members of each side are pivotally joined at or near each end and can thus be moved to form a square or rectangle and a parallelogram. The intrinsic qualities of parallelograms enable a continuously-variable device adaptable to sloping stairs or flat floors for visualizing railings to be located above said stairs or floors.

Whether or not the height of a handrail, short wall, or other aid or barrier is strictly controlled by building code or regulation, the prospective handrail or barrier railing may be emulated and visually"tried out" by placing the invented tool on the floor or stairs to receive the rail and moving the invention to replicate the height and/or location of the feature to be installed. The tool may be adjusted so that top longitudinal member of the invented tool is placed at the actual level of the handrail or other railing, in order to temporarily simulate the actual handrail/railing. Alternatively, the tool may be adjusted to place the top surface of the top longitudinal member of the tool at the level of the bottom of the handrailing/railing, and, thus, the tool may also be used to mark the position of the bottom of the railing or to even support the bottom of the railing.

Whether on sloping stairs or flat floors, the top and bottom members of the inventive tool will be parallel to each other and to the corresponding stairs or floor. The height of the top longitudinal member may be moved within a certain range up or down. Thus, the invention may be placed temporarily in the subject location, it may be adjusted up or down according to taste or other criteria to chose a particular configuration for the prospective rail, and then the inventive device may be used to mark, align, plan, and/or visualize the layout of the railing or other feature for its construction.

Visualization and layout for construction are the essential purposes of the basic embodiment of the invention. However, other embodiments would perform those functions and/or perform additional functions such as providing means to measure distances or angles and providing support for actual installation of handrails. It is always a desired quality of the invention that it be very portable and amenable to transport within a case such as a carpenter's level case. Thus, the device is even more useful because it is more readily available.

DESCRIPTION OF THE PREFERRED EMBODIMENTS

Figure 1:
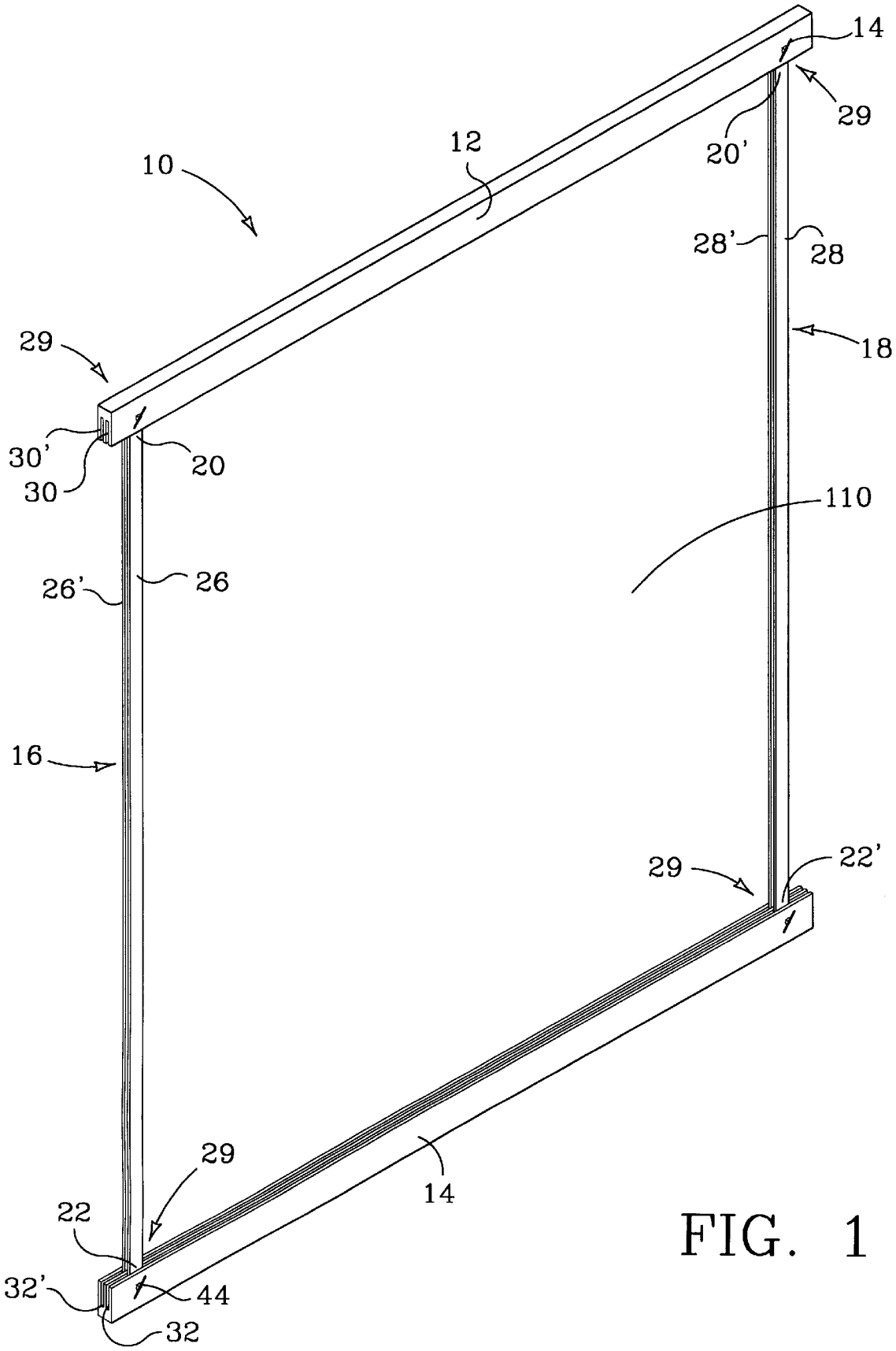
FIG. 1 is a perspective view of one embodiment of the handrail construction tool according to the present invention.

Referring to the Figures, there are shown several, but not the only, embodiments of the invented handrail construction tool. The preferred embodiment of the tool 10, shown in FIGS. 1–9, includes a top span 12 and a bottom span 14, with pivoting first and second side legs 16, 18 (also called legs 16, 18). First and second legs 16, 18 are each pivotally connected at or near their top ends 20, 20' and bottom ends 22, 22' to the top span 12 and bottom span 14, respectively. The two legs 16, 18 are preferably of equal lengths, or at least are connected to the top span 12 and bottom span 14 so that the spans are equidistant from each other all the way along their lengths. Also, the spans 12, 14 are of equal length, or at least the legs 16, 18 are connected to the spans so that the legs are at equidistant from each other all the way along their lengths. Thus, a rectangular structure is formed that may pivot to form a parallelogram of various angles A and geometrically-corresponding angles B.

Figure 2:
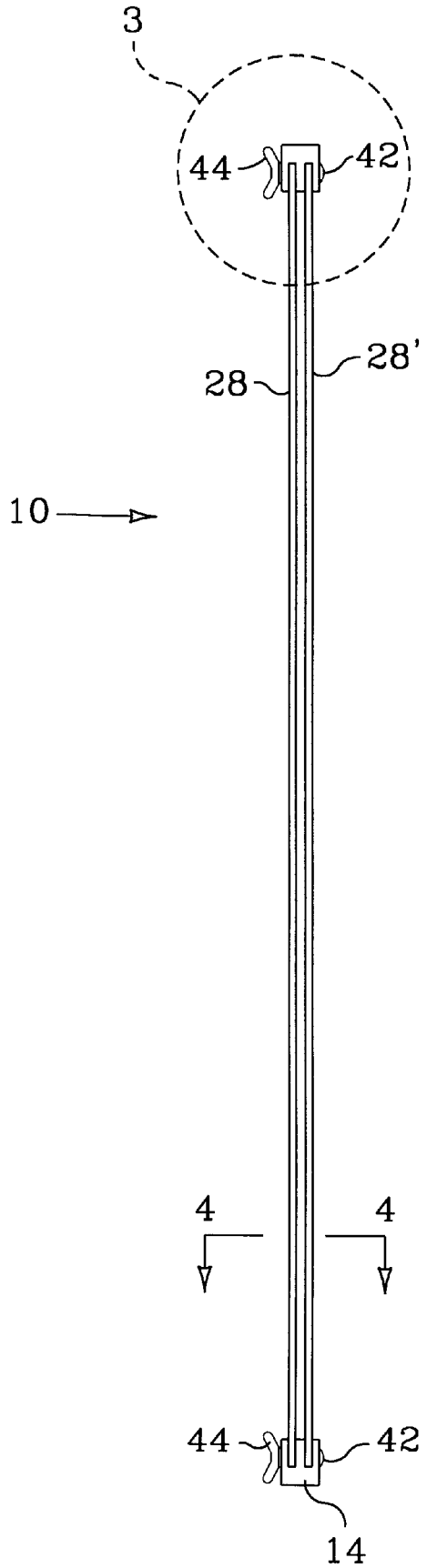
FIG. 2 is a right end view of the embodiment of FIG. 1.
Figure 3:
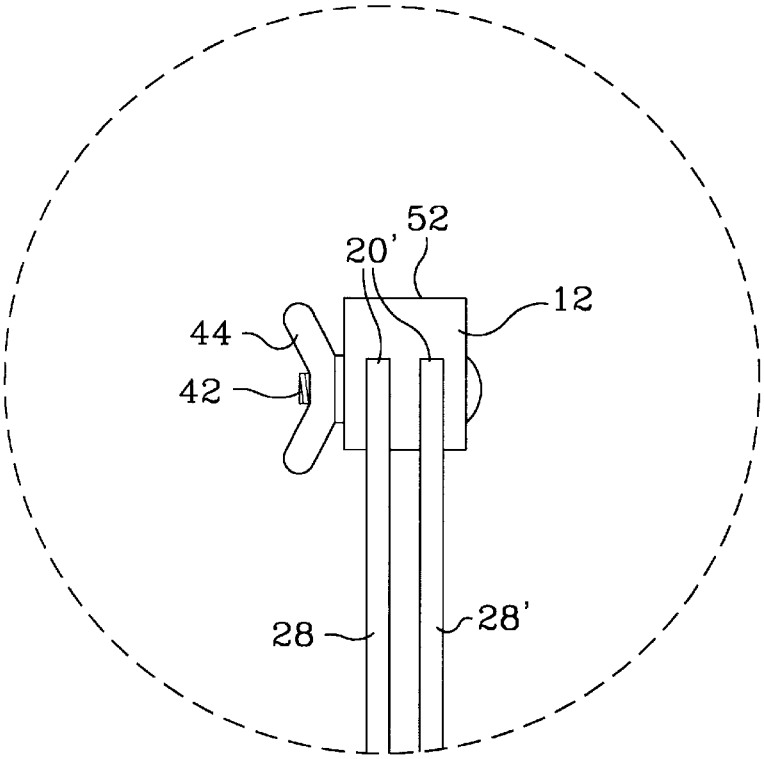
FIG. 3 is a detail of FIG. 2 illustrating the pivotal connection bolt and wingnut system.
Figure 4:
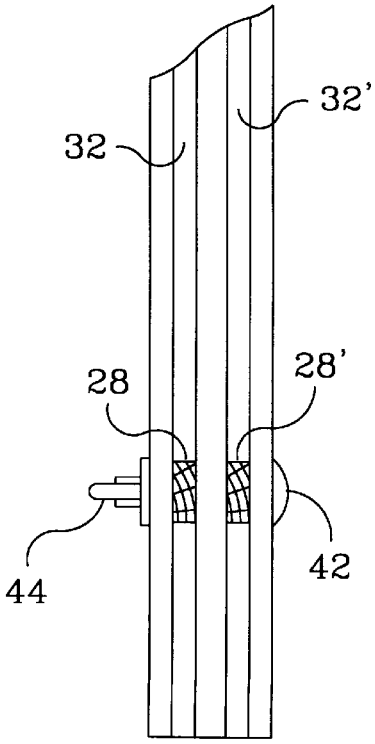
FIG. 4 is a cross-sectional view along the lines 4—4 in FIG. 2, illustrating the configuration of the longitudinal member channel-and-insert pivotal connection system, with bolt and wingnut fastener.

The pivotal connection joints 29 between spans and legs are preferably at or near the ends of the spans and legs, as illustrated by FIGS. 2–4. In the preferred embodiment, pivotability, strength and rigidity are achieved by a system of the ends of leg portions inserted into and pivoting in channel(s) in the spans. More specifically, each leg 16, 18 comprises two parallel leg portions 26, 26', 28, 28' which are received, and which pivot simultaneously, in their respective channels 30, 30', 32, 32' in the spans 12, 14. Thus, the leg portions are spaced apart by the interior wall 23, 23' of the spans, which may be an integral part of the spans or an elongated panel added as a spacer between the leg portions.

Figure 13:
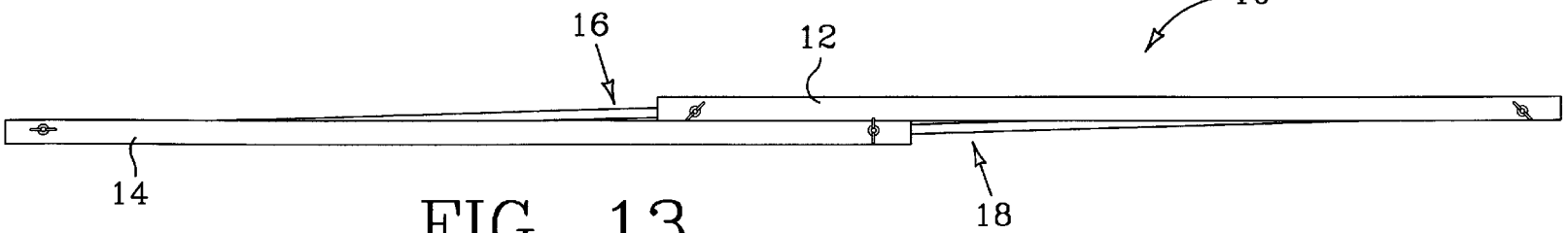
FIG. 13 is a front view of the embodiment of FIG. 12, shown pivoted to its maximum amount, that is, collapsed for storage and carrying.

The two channels (30, 30', 32, 32') in each span may extend all along the spans 12, 14 from end to end. Alternatively, the channels may extend from the ends inward part of the way toward the center, that is, an appropriate distance to allow the leg portions 26, 26', 28, 28' to pivot in both directions to collapse a desired amount against the spans. As shown in FIGS. 1 and 13, adaptation for complete collapsing of the top span against the bottom span is preferable (in either side direction, right or left in FIG. 1), and is made possible by the channels 30, 30', 32, 32' extending all the way along the lengths of the spans. Thus, the pivotal connections allow the legs 16, 18 to pivot preferably at least 160°–170°.

The connection of leg portions 26, 26', 28, 28' to spans 12, 14 is made by wing nut fasteners or other connectors that preferably allow both pivoting (when loosened or released) and locking of the tool 10 in a an angled or upright position (when tightened or engaged). Each wing nut system of the preferred embodiment includes a bolt 42 extending through aligned bores (not shown) that pass through the spans and the leg portions 26, 26', 28, 28' transversely to the lengths of the spans and leg portions. The wing nut 44 of each fastener may be screwed-in to tighten its respective joint or may be unscrewed to loosen the joint. Preferably, each of the four joints 29 has its own locking connector, but optionally, as few as one joint may have a locking connector. For example, only one joint on the top span 12 or one joint on the bottom span 14 may have a locking connector, while the other joints of the spans may be pivoting connectors without the locking features. In other words, to temporarily hold the tool at a desired angle, at least one of the angles between the top span 12 and a leg (16 or 18) must be temporarily fixed and/or at least one of the angles between the bottom span 14 and a leg (16 or 18) must be temporarily fixed.

The preferred tool 10 may be used in many stair and landing rail construction situations, as illustrated by FIGS. 5–9. Because of the adjustability of the angles of the spans 12, 14 relative to the legs 16, 18, the tool 10 may be said to adapt to various shapes, that is, a rectangle or variously-angled parallelograms. Use of the invented tool 10 allows the position of handrails, intermediate railings, or other generally horizontal or slanted building rails to be visualized, aligned, marked, and/or planned, and allows more accurate and error-free installation of such rails.

Figure 5:
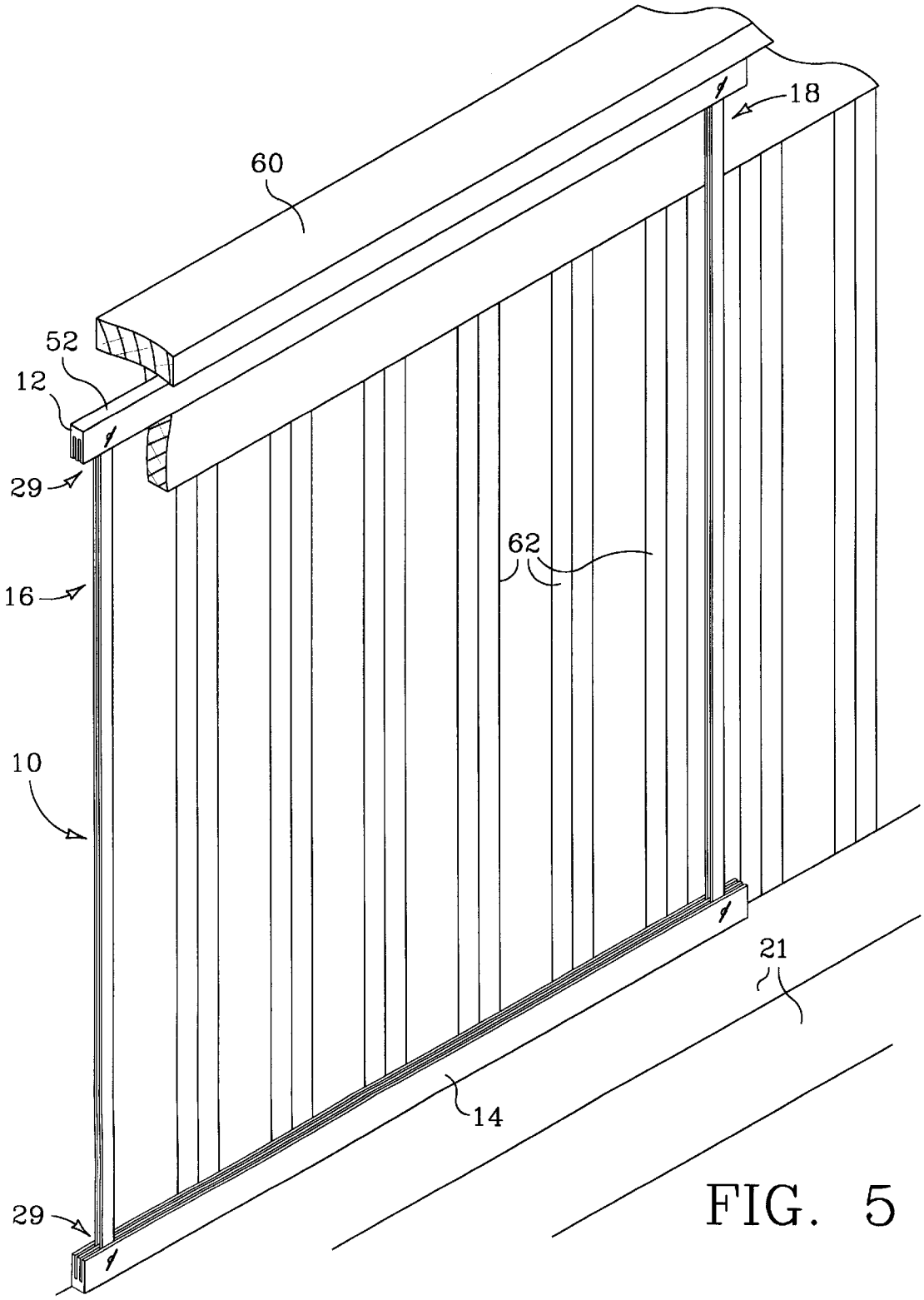
FIG. 5 is a perspective view of the embodiment of FIG. 1 shown in conjunction with a flat floor and balustrade and beneath a toprail.

In FIG. 5, the tool is tightened in a rectangular shape, with the legs 16, 18 generally vertical (and parallel to each other) and the spans 12, 14 generally horizontal (and parallel to each other). The tool 10 is shown in FIG. 5 in use with the top handrail 60 of a horizontal landing construction, with the top surface 52 of the tool top span 12 being the reference for placement of the bottom surface of the handrail 60. Several operations may be appropriate while the tool is in place: the carpenter/user may mark with a pencil the proper location of the handrail 60, may saw the balustrades, or make other adjustments or marks.

FIG. 5 shows the handrail 60 already set in place for securement to the vertical bannisters 62, with the tool 10 still in place. Alternatively, the tool 10 may be used to visualize the actual height of the handrail, by locking the tool 10 in a configuration which places the top span 12 at the level of the proposed handrail, so that the carpenter/user views the top span 12 as a simulation of the handrail. In this case of using the tool as a simulated handrail, the tool 10 is typically removed before placement of the actual handrail 60.

Figure 6A:
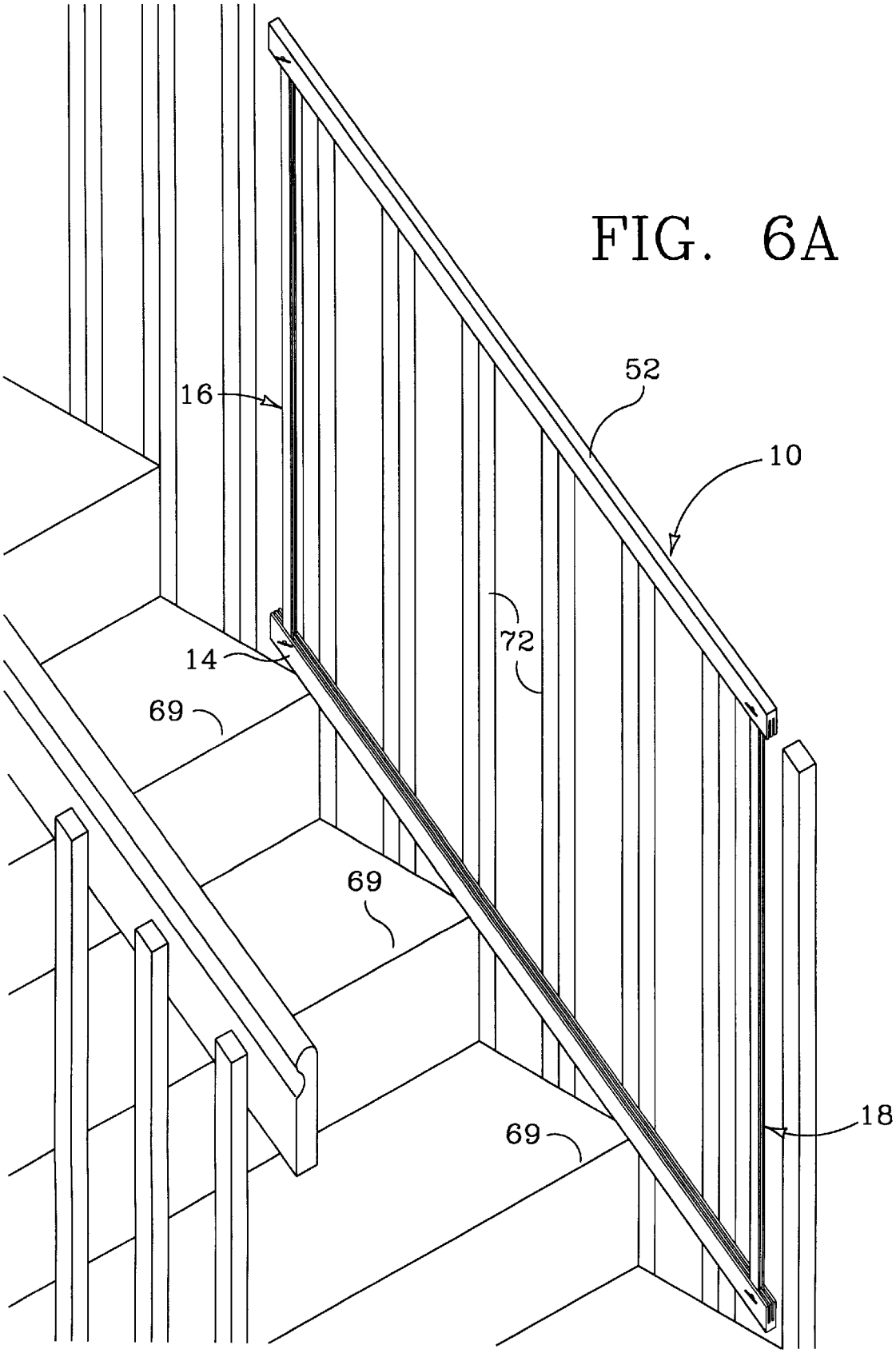
FIG. 6A is a perspective view of the embodiment of FIG. 1 shown in conjunction with a stair flight and balustrades for visualization/marking of the preferred location of a handrail.
Figure 6B:
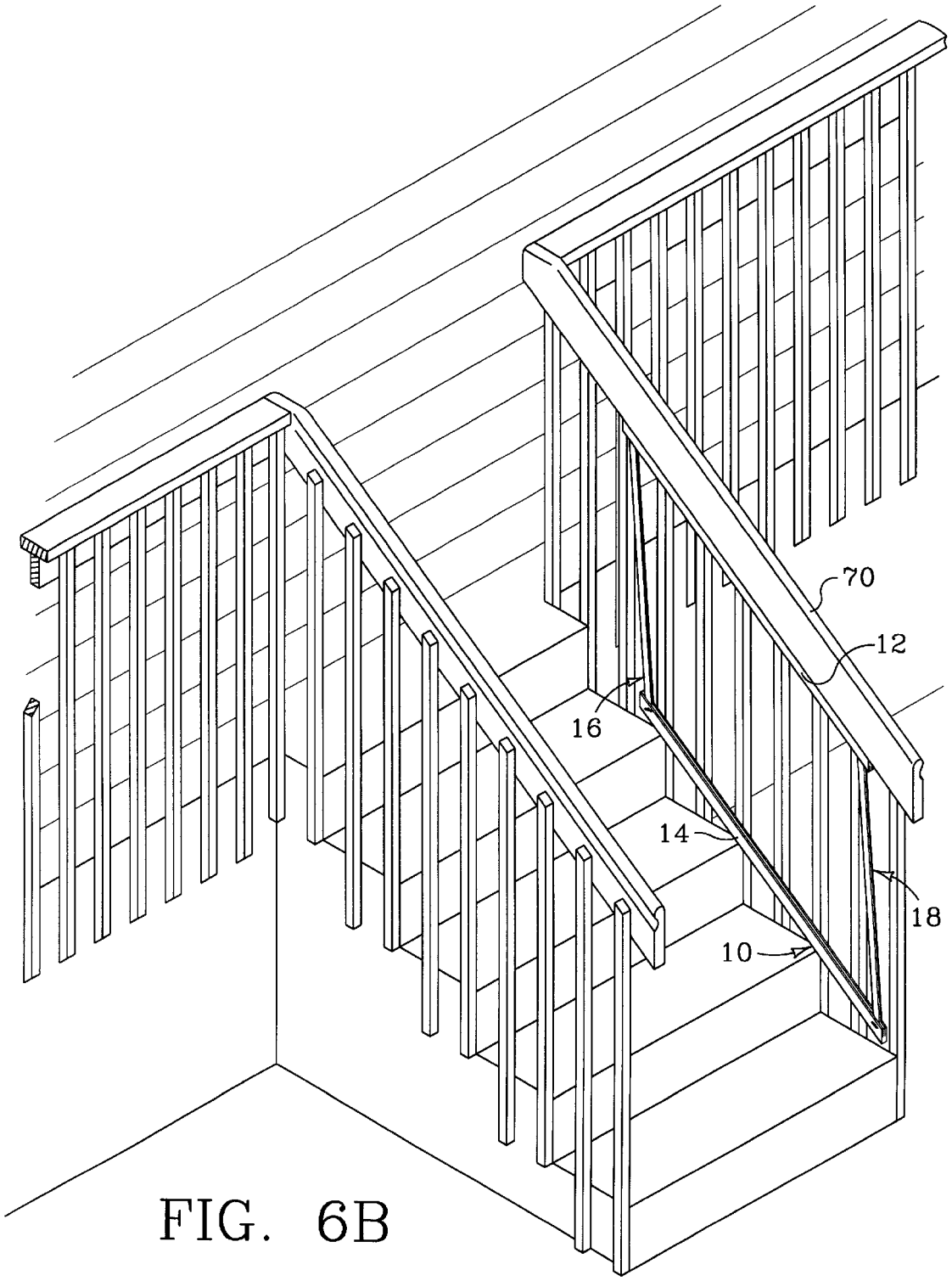
FIG. 6B is a perspective view of the embodiment of FIG. 6A shown with the handrail installed and the tool underneath the handrail.

In FIG. 6A, the tool 10 is shown tightened at an angle corresponding to the slope created by the stair corners 69, and placed in position on the stairs for visualization and/or marking of a slanting handrail 70. The vertical balustrades 72, wall or other vertical surface to which the handrail is to be attached, may be marked on their sides corresponding to the top span 12 to clearly show the carpenter the preferred handrail 70 position, that is parallel with the slope of the stairs. Alternatively, as in FIG. 6B, the tool 10 may be adjusted downward slightly and the handrail 70 may be set in place on/over the tool 10 for further confirmation of the proper angle, orientation, and aesthetic impact of the handrail/balustrade assembly.

Figure 7:
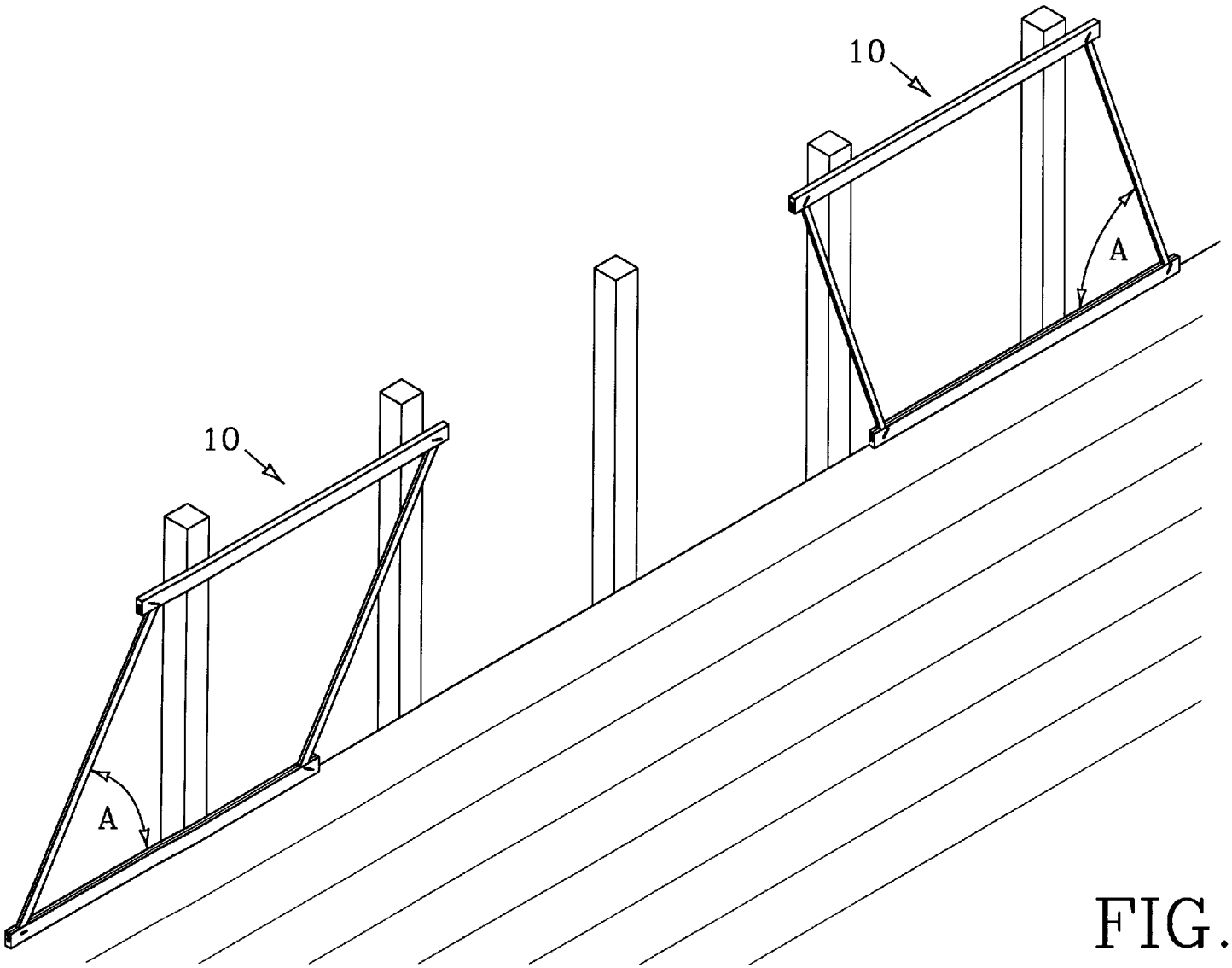
FIG. 7 is a perspective view of a pair of the inventive tools pivoted to less than full, extended height and shown in conjunction with a flat floor and standing balustrades for visualizing and planning rail placement.

In FIG. 7, two differently-fastened tools 10 are shown in use against vertical bannisters 80. The tool 10 on the left of FIG. 7 is fastened to have a small acute angle A in order to place its top span at an appropriate height for visualizing/locating an intermediate railing part way down the balustrades. The tool 10 on the right of FIG. 7 is fastened to be more upright, that is, to have a larger acute angle A, so that the top span is at an appropriate height for visualizing/locating the top railing of the particular construction shown.

Figure 8:
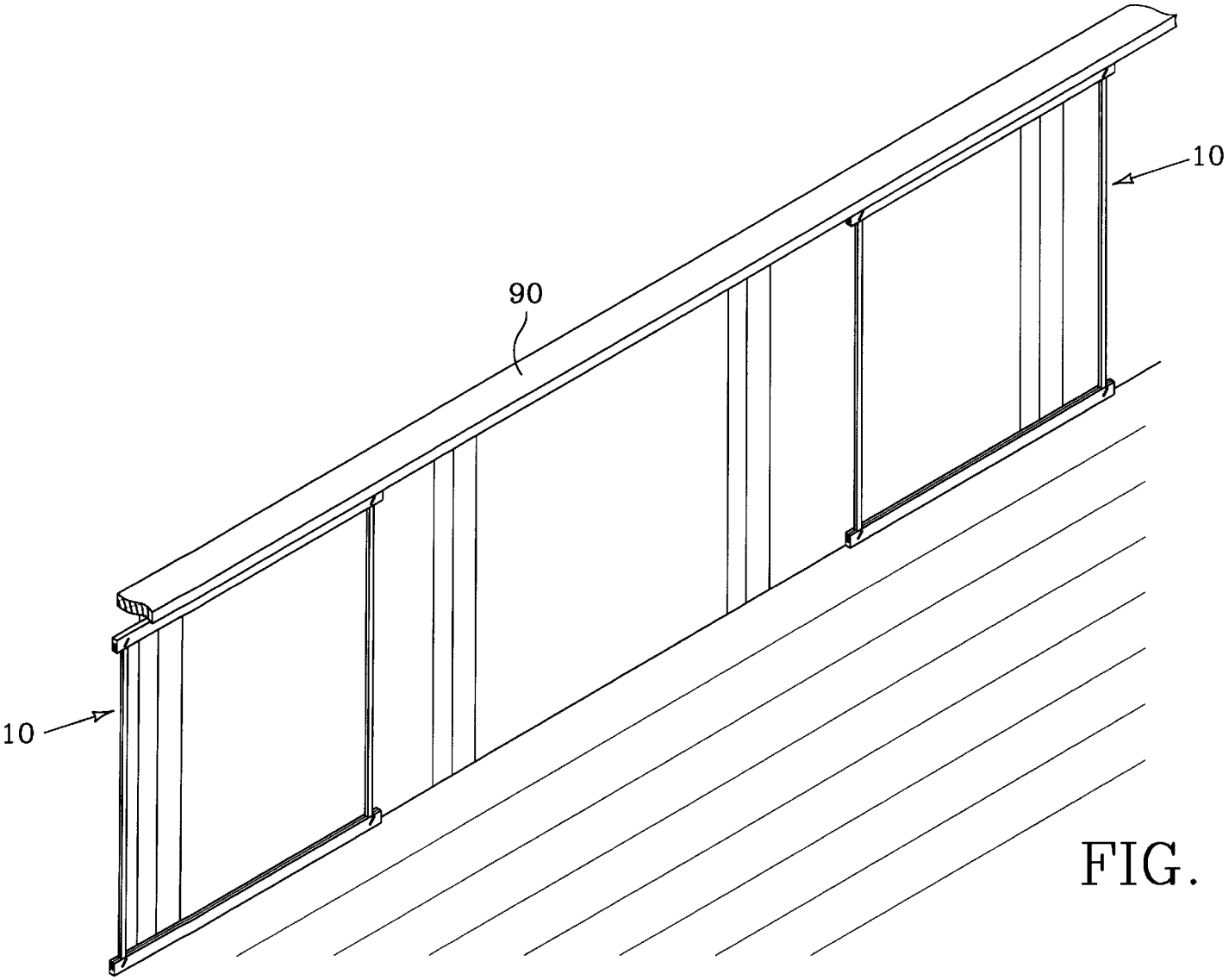
FIG. 8 is a perspective view of a pair of the invented tools extended to full height and shown in conjunction with a flat floor, balustrades, and toprail.

FIG. 8 shows an alternative construction and use of the tool 10, in which two tools 10 are fastened so that their spans and legs are at right angles. Both tools 10 in this Figure are in use for visualizing and locating, and, optionally, supporting the top handrail 90 during its positioning and securement.

Figure 9:
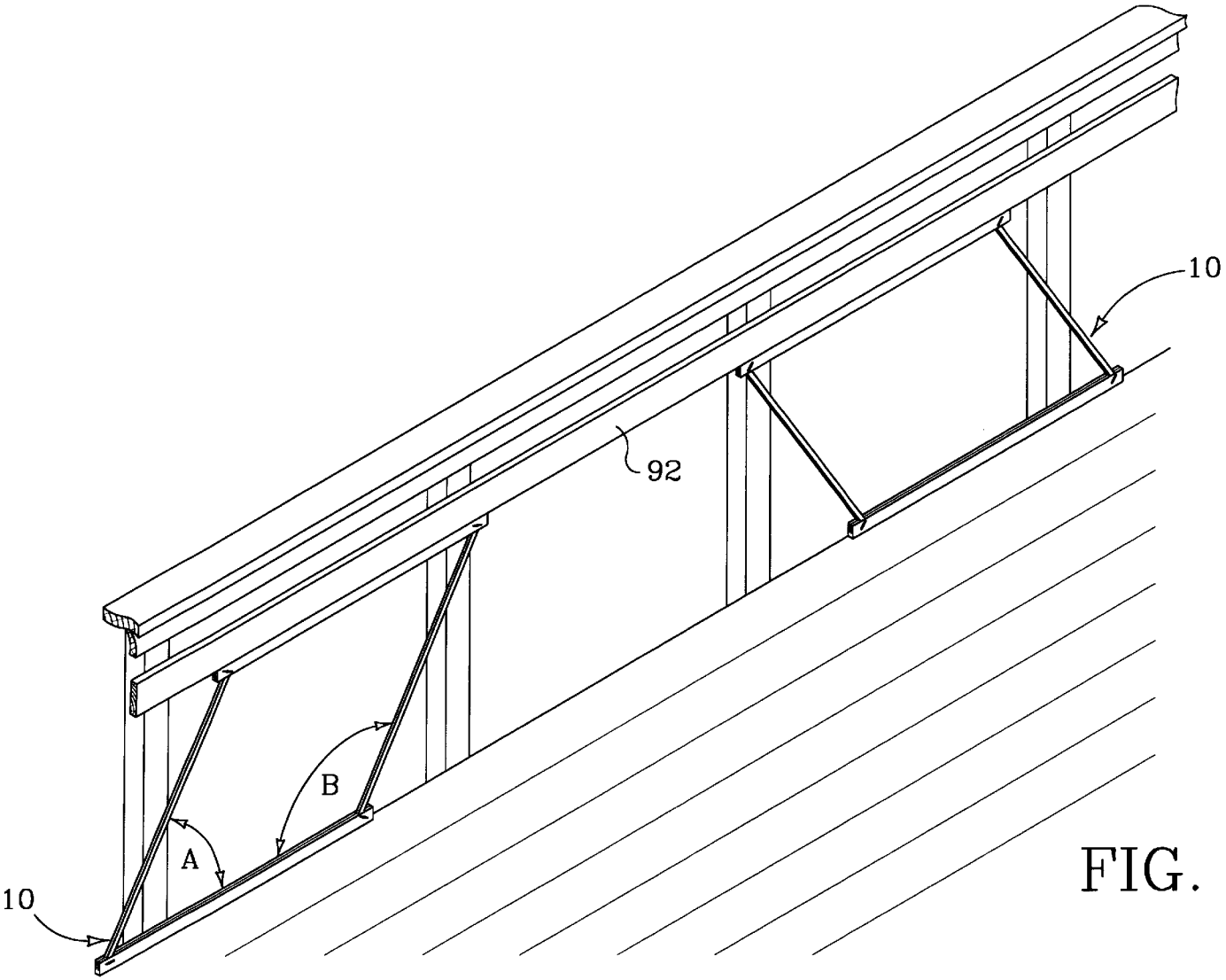
FIG. 9 is a perspective view of a pair of the tools of FIG. 7 pivoted to less than full height and shown in conjunction with a flat floor, balustrades and intermediate rail.

FIG. 9 shows an alternative construction and use of the tool 10, in which two tools 10 are fastened so that the tool may be described as partially collapsed, one to the right and one to the left, with acute angles (A) and obtuse angles (B) between top and bottom spans and the legs. Both tools 10 are being used for visualizing and locating an intermediate railing 92. As discussed above, the tools 10 may be used only to mark, visualize, or plan the placement of the railing 92 or other rail member, or, as portrayed in FIG. 9, the tools 10 may also be used to support or partially support the railing 92 while or prior to it being secured. Alternatively, or additionally, the carpenter may hold the railing in place by hand while securing it to the other members of the bannister construction.

In FIG. 9, and in the other Figures illustrating the tool being still in place under the rail after positioning and/or securement of the rail, the tool may be removed by different methods, depending on the design of the rail being installed and how snug is the fit and frictional engagement of the top surface of the top span and the bottom surface of the rail. If the rail is tightly engaged on top of the tool, or if the rail has a lip which prevents the tool from being slid outward from the rail, then the span-leg connectors may be loosened and the tool collapsed for removal. If the rail is not tightly retaining the tool and the rail does not have a lip or other protrusion that captures the tool, then the tool may be slid out away from the rail, without loosening of the connectors, for reuse or storage.

Figure 10:
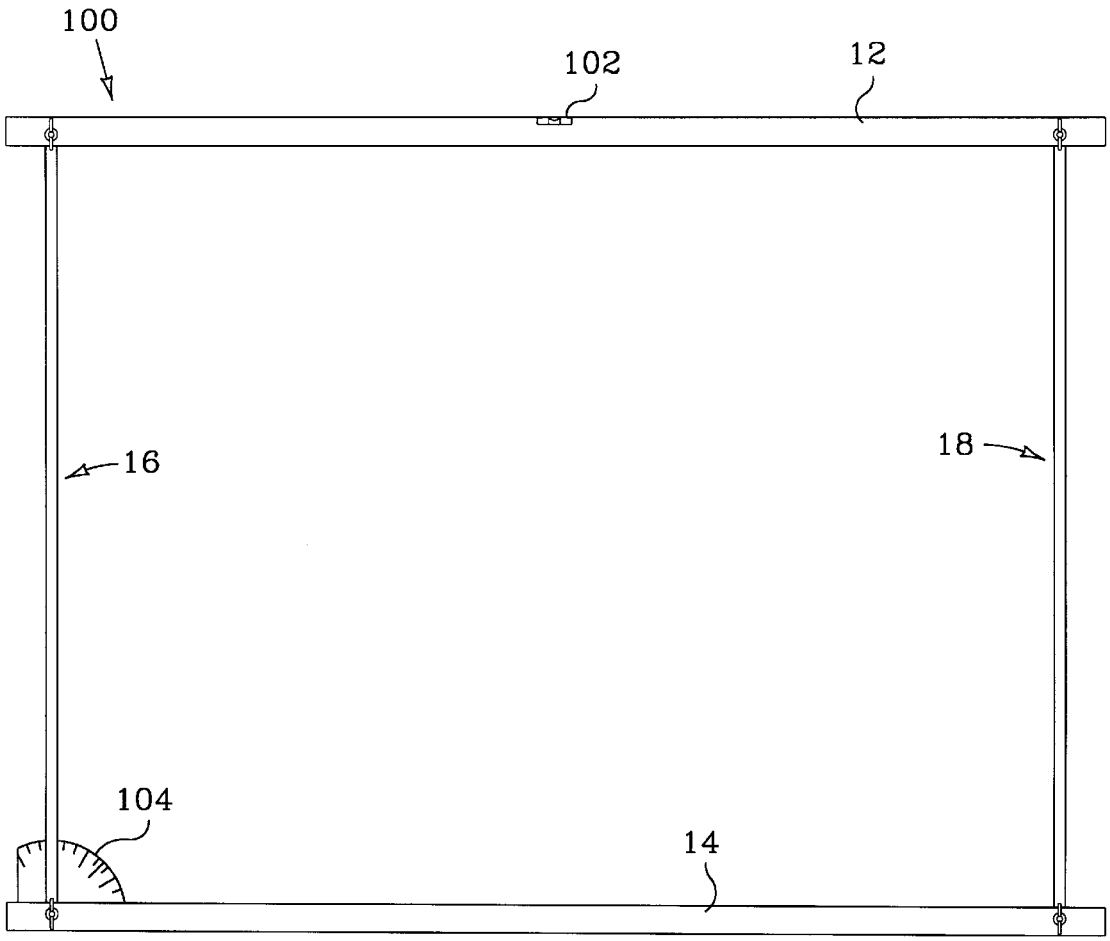
FIG. 10 is a front view of an alternative embodiment of the invented with optional bubble level and degree measuring means.
Figure 11:
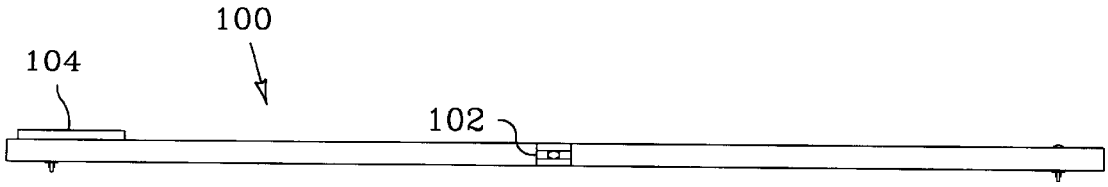
FIG. 11 is a top view of the invented tool of FIG. 10.

FIG. 10 shows an alternative embodiment of the tool 100, which includes a level device and an angle indicator 104. The level device is preferably a bubble-level 102, which is useful in cases where it is desirable to position a rail in exactly a horizontal orientation. The angle indicator 104 is preferably a plate 106, attached to the bottom span 14, with angle markings relative to the bottom span 14. The angle indicator 104 adds ease of use to the tool, because the carpenter may set the angle of the tool to match a planned or known angle of the particular stairs or may record/remember the angle for future use when the same tool configuration is desired in the future. FIG. 11 illustrates a top view of the tool 100, showing the bubble level 102.

Figure 12:
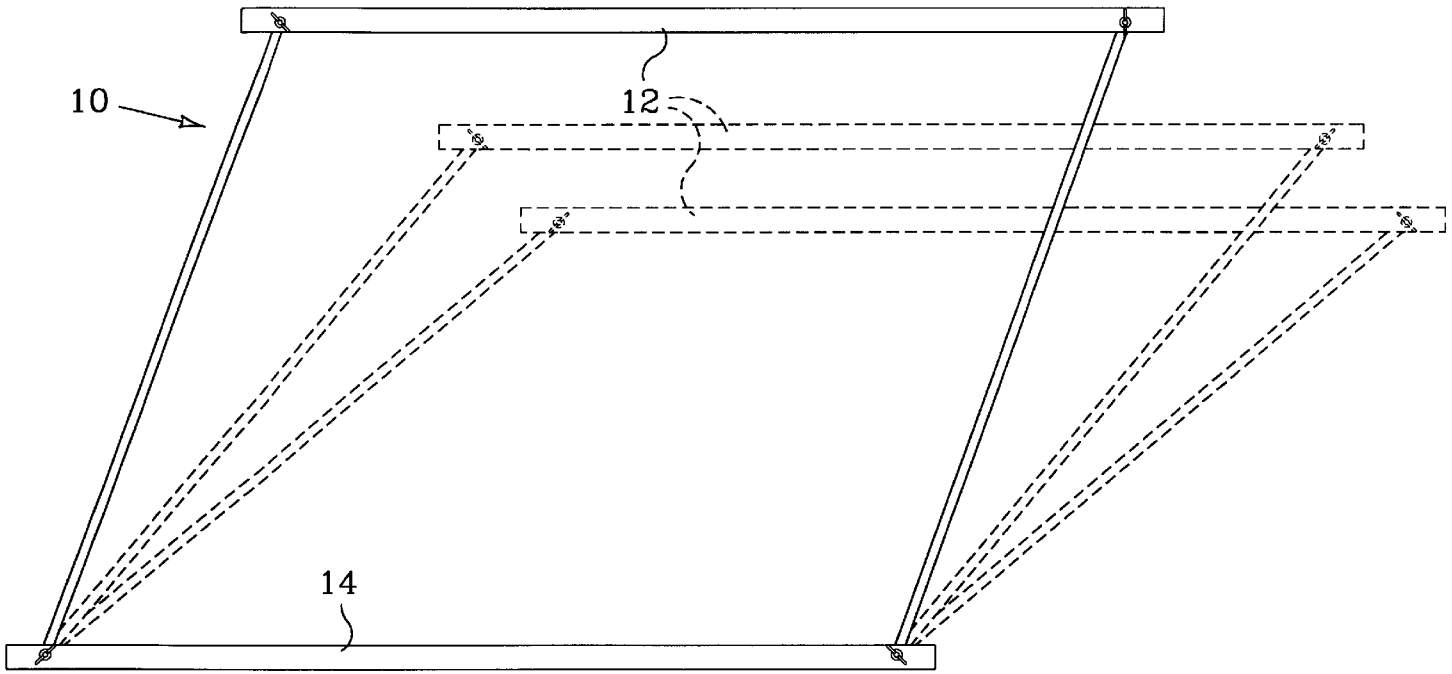
FIG. 12 is a front view embodiment of FIG. 1 shown pivoted to various degrees in dashed lines to illustrate the device's adjustability.

FIGS. 12 and 13 illustrate the great extent of adjustability of the tool 10. FIG. 12 shows alternative configuration of the tool (that is, differing angles A), and how the top span 12 and bottom span 14 stay parallel to each other. FIG. 13 illustrates maximum collapsing of the tool 10 to a nearly flat configuration for transport and storage.

The invented handrail construction tool is simple to manufacture and use. It does not require cross-members extending between its spans or legs across the central space 110 of the tool. It does not require connections to any other apparatus or any rulers or sleeves that slide relative to other of its parts. The surfaces of its spans and legs need not be marked with ruler-style graduations or other indicia. In its simplest form, the tool may consist of four elongated members pivotally connected in a rectangular shape so that opposing members are parallel and having means for locking at least two of the members in position relative to each other. One or more of the four members may comprise two or more portions (such as leg portions 26, 26', 28, 28') which form the required longitudinal members. A top member, a bottom member, and two side members are preferred because this rectangular or parallelogram shape tends to be a strong and stable shape, which will not collapse until the user purposely unlocks the locking means. The locking means preferably is part of one or more of the connectors that connect the longitudinal members of the tool (top member, bottom member and side members), but alternatively, may be other structure, such as an additional bar that extends between the longitudinal members or between the corners of the tool.

Although this invention has been described above with reference to particular means, materials and embodiments, it is to be understood that the invention is not limited to these disclosed particulars, but extends instead to all equivalents within the scope of the following claims.

I claim:

1. A construction tool for use with stairways and landings, the tool comprising:

a generally straight elongated bottom member having two ends;

a generally straight elongated top member spaced from and parallel to the bottom member and having two ends;

two generally straight side legs each having a bottom end and a top end, the bottom ends being pivotally connected to the bottom member near its two ends, respectively to define two respective pivotal connection, the top ends being pivotally connected to the top member near its said two ends respectively to define two additional respectively pivotal connections, the side legs pivot relative to the top member and bottom member in the plane of the top member and bottom member to a range of pivotal positions comprising a fully upright position wherein the legs are about 90° to the bottom member and the top member, and to a collapsed position wherein the top member is near the bottom member;

at least one lock wherein each said lock is adapted to temporarily lock a one of said pivotal connections from pivoting;

wherein the top member, bottom member and side legs form a frame having an opening between them;

wherein the tool comprises no structures extending across the opening;

wherein the top member and bottom member each comprise two parallel channels running substantially along their entire lengths;

wherein each side leg comprises two parallel leg portions pivotally received in said channels; and wherein the channels are adapted to substantially receive the leg portions when the leg portions pivot into the collapsed position to place the top member near the bottom member.

2. A tool as in claim 1, wherein the two side legs are parallel to each other at all pivotal positions, and the top member and bottom members are parellel to each other at all pivotal positions.

3. A tool as in claim 1 wherein the at least one lock comprises four locks.

4. A tool as in claim 1, wherein the top member has a top surface and a bubble level near the top surface.

5. A tool as in claim 1, wherein the legs pivot simultaneously 160°–170° relative to the bottom member.

6. A construction system comprising:

a plurality of stairs having outer corners;

a plurality of balustrades rising up from the stairs; and a parallelogram construction tool comprising:

an elongated straight bottom member resting on a plurality of the stair corners near the balustrades;

two legs pivotally connected to and extending up vertically from the bottom member and near the balustrades;

an elongated straight top member pivotally connected to top ends of the legs for representing a railing;

wherein the legs are parallel to each other and the top member is parallel to the bottom member;

wherein the legs pivot relative to both the top member and the bottom member, so that the legs are adapted to pivot the top member down near the bottom member; and a first lock adapted to temporarily prevent pivoting of the legs;

wherein the top member in all pivotal positions remains parallel to the bottom member and to a line passing through the stair corners, for representing and marking the location of a railing on the balustrades.

7. A construction system as in claim 6, wherein the top member, bottom member and legs form a parallelogram-shaped frame with a central opening and the tool comprises no members that extend across the central opening.

8. A construction system as in claim 6, wherein the tool further comprises a second lock, a third lock, and a fourth lock for preventing the legs from pivoting and wherein the locks are near a top end and a bottom end of each of the legs.

9. A method of stair and walkway railing construction comprising:

providing a tool comprising a parallelogram frame having an elongated generally straight top member, an elongated generally straight bottom member, and two legs pivotally connected at their top ends to the top member and pivotally connected at their bottom ends to the bottom member, wherein the two legs are spaced from each other and parallel to each other, the top member and bottom member are spaced from each other and parallel to each other to create a central opening in the frame;

placing the tool so that the bottom member rests on a first building surface and the legs extend up near a generally vertical second building surface;

pivoting the legs to place the top member at a desired elevation;

locking the frame so that the legs do not pivot, to hold the top member at the desired position;

installing a railing on the vertical second building surface near the position of the top member.

10. A method as in claim 9, wherein the first building surface comprises outer corners of a plurality of stairs, the stairs having a slope, and wherein the bottom member rests on the corners of the stairs to be at the slope of the stairs and to position the top member parallel to the slope of the stairs.

11. A method as in claim 9, wherein the first building surface is a stair landing floor surface, and the bottom member rests on the floor surface to position the top member parallel to the floor surface.

12. A method as in claim 9, wherein the vertical second building surface comprises balustrades.

13. A method as in claim 9, further comprising marking the vertical second building surface at the top member and removing the tool from the second surface before installing the railing.

14. A method as in claim 9, comprising adjusting and locking the pivotally connected two legs to place the top member at an elevation below the desired position of the railing, and installing the railing directly above the top member and parallel to the top member prior to removing the tool.

15. A method as in claim 9, wherein the frame is locked before placing the tool on the first surface.

16. A method as in claim 9, wherein the frame is locked after placing the tool on the first surface.

* * * * *